US005469583A

United States Patent [19]

Akeley et al.

[11] Patent Number: 5,469,583

[45] Date of Patent: Nov. 28, 1995

[54] STRAP LOCK BUCKLE

[75] Inventors: Tom Akeley, Hermosa Beach; Neil West, La Mirada, both of Calif.

[73] Assignee: Bell Sports, Inc., Cerritos, Calif.

[21] Appl. No.: 122,748

[22] Filed: Sep. 16, 1993

[51] Int. Cl.[6] ..... A42B 3/02

[52] U.S. Cl. ..... 2/421; 2/425; 24/170; 24/191

[58] Field of Search ..... 2/421, 425, 416, 2/417, 418, 419, 420; 24/170, 191, 193, 516, 515

[56] References Cited

U.S. PATENT DOCUMENTS

| | | | |
|---|---|---|---|
| 1,079,080 | 11/1913 | Ward | 24/170 |
| 3,608,158 | 9/1971 | Bengtsson | 24/170 |
| 4,897,888 | 2/1990 | Broersma et al. | 2/421 |
| 5,012,533 | 5/1991 | Raffler | 2/420 |
| 5,291,638 | 3/1994 | Huang | 24/191 X |

OTHER PUBLICATIONS

Pages of ITW Nexus Catalog showing cam buckles sold under Part Numbers 100–0325, 100–0825, 100–0327 and 127–3200.

Pages of the National Molding Corporation catalog showing cam buckles sold under Part Number 4535.

*Primary Examiner*—Peter Nerbun

*Attorney, Agent, or Firm*—Ladas & Parry

[57] ABSTRACT

A buckle device for temporarily fastening at least two straps together, the device having a base unit and an arm rotatably mounted on the base unit. The arm has a strap engagement part with a protuberance thereon, the arm being movable from a locked position to an open position, the arm in its locked position forcing the at least two straps into engagement with each other between the engagement part and the base unit. The arm is movable to an open position wherein the engagement part is rotated away from the straps so that the straps are free to move relative to each other and relative to the device.

2 Claims, 3 Drawing Sheets

FIG. 5
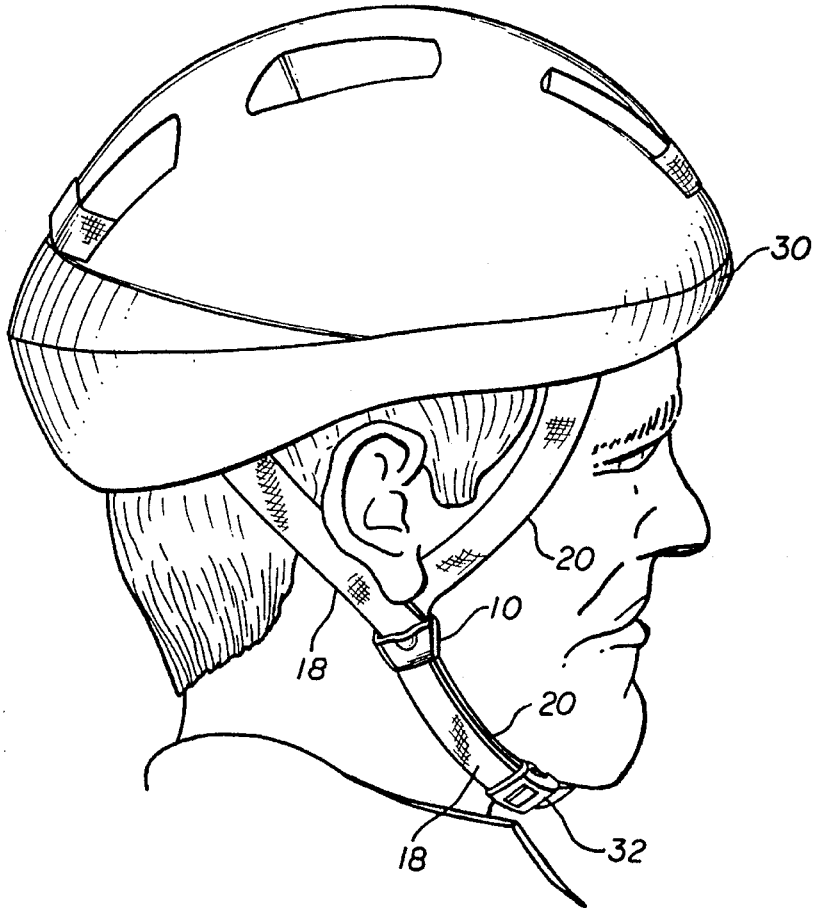
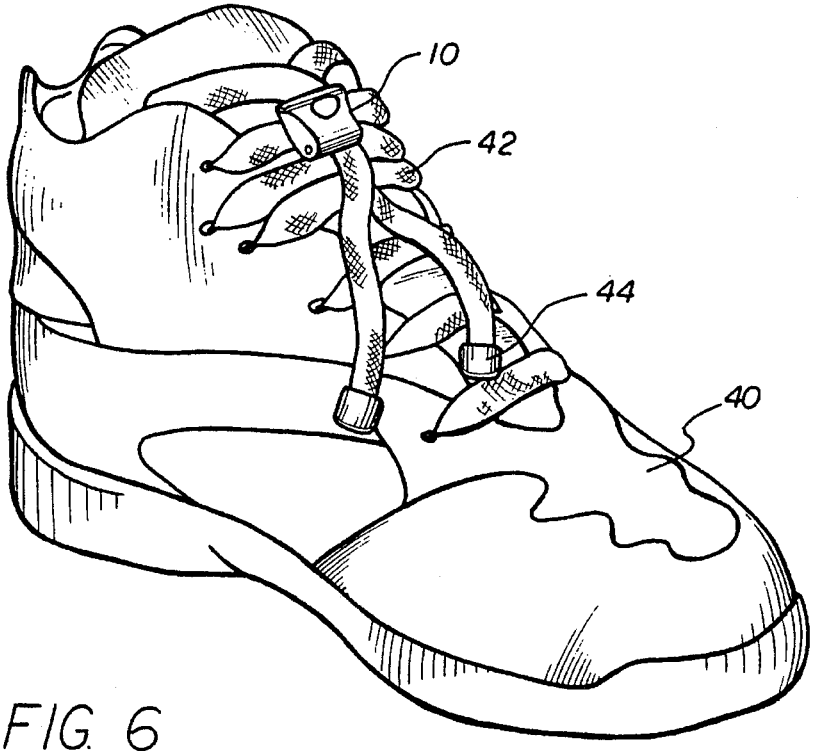
FIG. 6

STRAP LOCK BUCKLE

TECHNICAL FIELD

The present invention relates to locking devices, particularly buckles of the type which may be used with straps or cords and which have an over-center locking mechanism.

BACKGROUND OF THE INVENTION

Locking devices have been very commonly used in the prior art to lock two straps or cords together by means of an intermediary device. Such locking devices are commonly found on camping gear, particularly backpacks; motorcycle and bicycle helmets; and other sporting products. In the prior art such locking devices were commonly and originally made of metal, but in more recent years have been made from various plastic materials. One type of prior art locking device comprised a buckle having two units which could be locked together with one strap or cord secured to one unit and another strap or cord connected to the other unit.

In addition to the lock-together type of buckle, cam buckles have also been widely used in the prior art. Exemplary prior art cam buckle include cam buckles sold under part numbers 100-0325, 100-0825, 100-0327 and 127-3200 by ITW Nexus of Wood Dale, Ill.. Cam buckles have also been sold under part number 4535 by National Molding Corporation of Farmingdale, N.Y.. In these devices, one strap is secured to one end of the buckle and the other strap is fed through the buckle and is locked between two portions of the buckle.

Also in the prior art, bicycle helmets have become a widely accepted accessory for bicycle riders. Indeed, in many states of the United States, the state legislatures are requiring or considering requiring all bicyclists to wear helmets when riding bicycles, similar to the legal requirements imposed on motorcyclists to wear appropriate safety helmets. Conventional bicycle helmets have a protective portion which protects the crown of the user's head, with the lower edge of the protective portion being typically placed at approximately at the top of the ears of the wearer. Conventionally, a pair of the straps on each side of the helmet have been coupled together by some means at a point below the user's earlobe, with one or both straps then continuing on to a releasable lock-together type buckle disposed under the wearer's chin. The fastener used at the junction of the two straps on either side of the helmet under the user's ear have typically permitted adjustment of the length of the straps so that the helmet could be made comfortable for the user, but also it has been necessary, in the prior art, for the user to have to remove the helmet in order to make adjustments conveniently. Alternatively, if the fastener used at the junction of the two straps is adjustable on the head of the user, it also has had a propensity to release while the helmet was in use, so that the point where the two straps came together was not fixed. Such helmets have been manufactured by Bell Sports, Inc., the assignee of this patent and by others.

It is an object of the present invention to provide a buckle or locking device capable of locking two straps or cords together, with the buckle being conveniently adjustable relative to the straps when the buckle is in an open position, and securely locking the two straps together when in a closed position.

It is another object of the invention that the position which the buckle takes relative to the straps be independently adjustable for each of the straps when the buckle is in its open position and that both of the straps should be locked in place relative to the buckle and relative to each other when the buckle is in its closed or locked position.

BRIEF DESCRIPTION OF THE DRAWINGS

FIG. 5 is a side view of a bicycle helmet on the head of the user when the buckle described with respect to FIGS. 1–4 is employed to secure two straps together adjacent the earlobe of the bicyclist; and FIG. 6 is a perspective view of a shoe when the buckle described with respect to FIGS. 1–4 is used to secure the shoe laces together.

DETAILED DESCRIPTION

Figure 1:
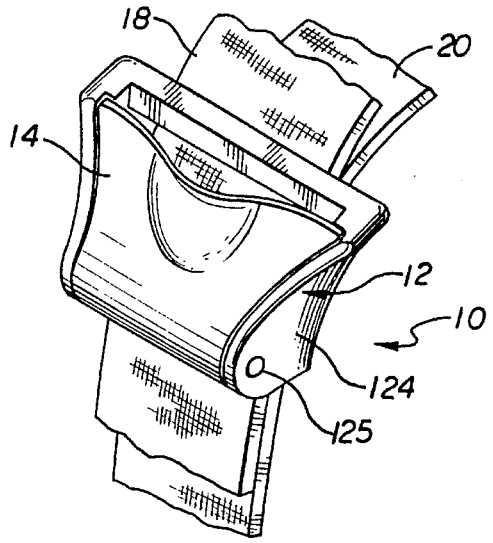
FIG. 1 is a perspective view of the buckle in accordance with the present invention.
Figure 2:
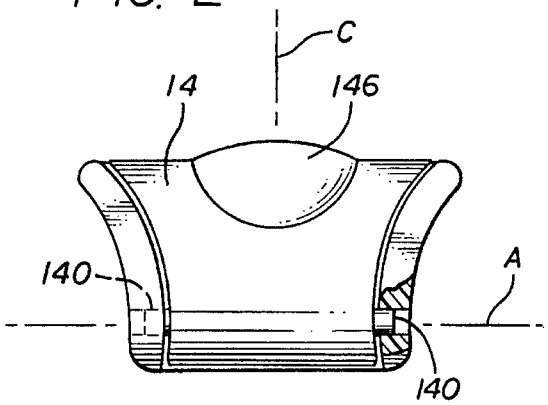
FIG. 2 is a top view thereof, with a sidewall shown partially cutaway to more clearly depict one of the protrusions on the arm of the buckle.
Figure 3:
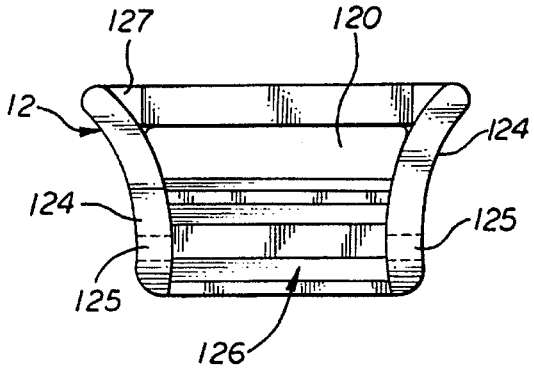
FIG. 3 is a top view thereof, with the arm removed from the base unit.

A buckle is shown in detail in FIGS. 1–4B. The buckle 10 comprises two pieces, namely a base unit 12 and a arm 14 which is rotationally mounted on the base unit 12. The base unit 12 and the arm 14 may be conveniently manufactured by molding from a suitable plastic materials, preferably nylon for arm 14 and acetal for base unit 12. Using different material keeps the buckle from squeaking when opened and closed. The base unit 12 preferably has an opening 120 therein through which straps 18 and 20 may pass to a channel 122 defined between the base portion and the arm 14. The channel 122 is defined by sidewalls 124 and a base portion 126, which form a part of the base unit 12. The sidewalls 124 include apertures 125 for receiving protrusions 140 on the arm 14. The protrusions permit the arm 14 to move rotationally on an axis A relative to the base portion 12. The arm is shown in its open position in FIG. 4A and in its closed position in FIG. 4B.

Figure 4A:
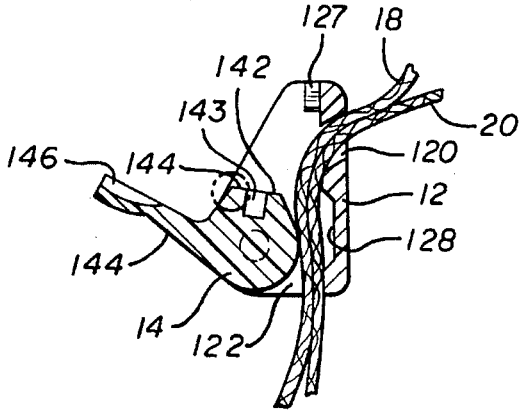
FIG. 4A is a side sectional view thereof, with the buckle in its open position.
Figure 4B:
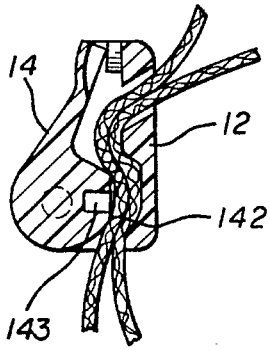
FIG. 4B is a side sectional view thereof, with the buckle in its closed position.
Figure 4C:
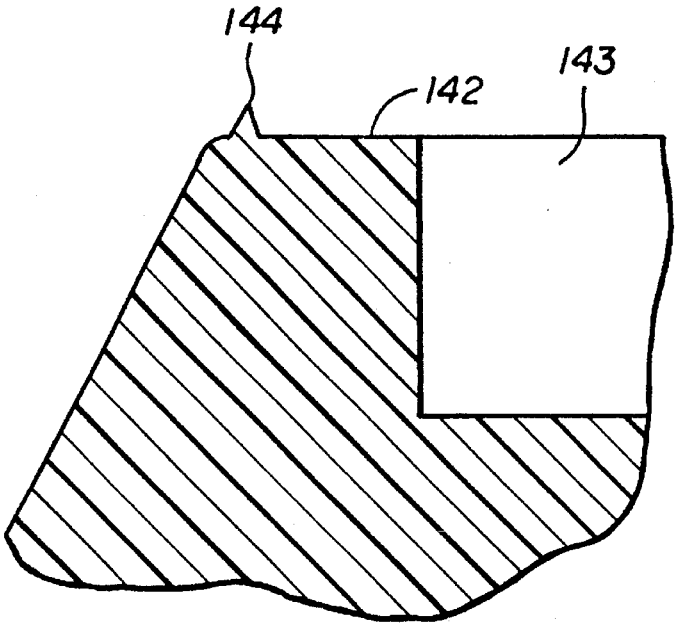
FIG. 4C is a blown-up view of a portion of FIG. 4A.
Figure 4D:
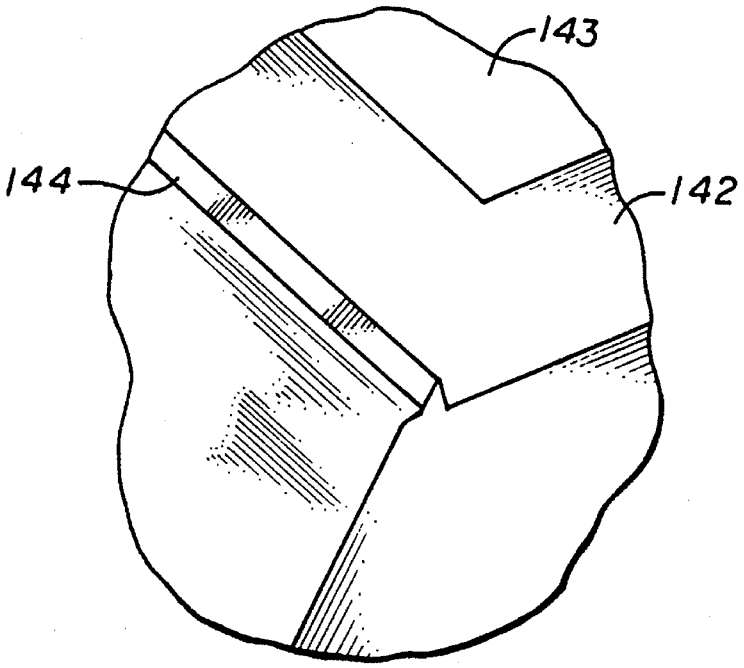
FIG. 4D is a perspective view of the blown-up portion depicted in FIG. 4C.

The arm 14 has a protuberance or engagement part 142 which engages the adjacent strap 18 and pushes it against the distal strap 20 and the base unit 12 when the buckle is in its locked position, that is, as shown in FIG. 4B. A recess 128 is provided in the base unit 12 confronting the engagement part 142 when the buckle is in its closed position. The engagement part 142 is shaped such that when the arm 14 is moved from its open position to its closed position, the engagement part 142 presses straps 18 and 20 together and into recess 128, thereby locking the two straps together and to the buckle 10. The engagement part 142 starts to engage the two straps 18, 20 when its lever 144 is about 45° to base portion 126, and as lever 144 is moved to the closed position contacting pedestals 127, the engagement part 142 moves to a position conforming recess 128, causing the straps to be squeezed together and to change directions thereby providing a locking effect and tending to keep the buckle in its closed position, once it is closed. As is indicated in FIGS. 4A and 4B, and shown more clearly in FIGS. 4C and 4D which depict a blown-up portion of FIG. 4A, engagement part 142 preferably has a small tooth 144 along one edge of part 142, which engages strap 18 when the buckle is in its closed position. The straps 18 and 20 are conventionally made of a woven nylon material and the tooth 144 tends to engage woven nylon material between the woof (horizontal threads) thereof when the buckle is closed.

The buckle preferably has a flared configuration between the two sidewalls 124 so as to conveniently permit the straps 18 and 20 to diverge, as they preferably do when the locking device is used on a bicycle helmet or in other applications, as will be described. Thus the sidewalls 124 are preferably arcuate and start flaring outwardly away from centerline C beginning about the point that the axis A intersects the sidewalls 124.

The arm 14 preferably has a fingernail or thumbnail tab 146 which can be conveniently engaged by the user so as to move the arm 14 from its closed position to its open position, when its desired to unlock the buckle 10. Arm 14 has a recess 143 formed to eliminate excess material in the manufacture of arm 14.

FIG. 5 is a right side view of a bicycle safety helmet 30 disposed on the head of a user, the left side view being essentially a mirror image thereof. The two straps 18 and 20 are attached or secured to the helmet 30 at least one end thereof in a conventional manner. The two straps 18 and 20 converge toward each other just below the user's ear and the straps may be fixed to each other using the buckle 10 described with reference to FIGS. 1–4B. As can be seen, the buckle 10 can be conveniently unlocked by the user since the finger tab 146 on arm 14 is in a position for convenient use. Moreover, those skilled in the art will appreciate that since the two straps 18 and 20 away from the buckle, the direction in which the buckle would be apt to move would be in a downwardly direction away from the user's earlobe, but such movement is in a direction which tends to cause arm 14 and its engagement part 142 to rotate into engagement with straps 18 and 20. Thus, in use, once the buckle 10 is locked, it tends to stay locked. When the buckle is unlocked, the two straps 18 and 20 may be freely adjusted with respect to each other. The buckle, however, does not fall completely off the straps 18 and 20 because the straps are threaded through both opening 120 and channel 122 and the ends of both of the straps 18 and 20 are conventionally locked together at the wearer's chin by a portion of lock-together buckle 32, which is too big to pass through opening 120 and/or channel 122. The straps 18, 20 may form a continuous strap after looping through the chin buckle 32, if desired.

The present invention may be also used to lock straps together in other applications, including straps which form the lace 42 of a shoe 40 as shown in FIG. 6. At least one end of the lace 42 conveniently may be enlarged, such as shown at numeral 44, so as to keep the buckle 10 in place on the lace.

The instant invention has been described in detail and two applications for the use thereof have been described with respect to a bicycle helmet (FIG. 5) and shoe laces (FIG. 6). It is believed that the instant buckle can be used in many other applications, and particularly in applications where it is desired to lock at least two straps together temporarily with a locking device that has an open position wherein both straps may be conveniently adjusted with respect to each other and with respect to the locking device and a locked position wherein both straps are temporarily fixed to each other. The described buckle may also be conveniently used where the straps diverge from each other on one side of the locking device, although those skilled in the art will appreciate, of course, that the buckle or locking device may also be used in applications where the straps 18 and 20 do not necessarily diverge.

Having described the embodiment with respect to a preferred embodiment thereof, modification will now suggest itself to those skilled in the art. The invention is not to be limited, therefore, to the disclosed embodiments, except as required by the appended claims.

What is claimed is:

1. A device for temporarily fastening at least two straps together, said device comprising:

(a) a base unit having:

(i) an opening therein sized to receive said at least two straps, and (ii) a base portion and opposing internal side-walls between which is received said straps, said opposing internal side walls flaring outwardly from a centerline of said base portion to accommodate straps which diverge in use;

(b) an arm rotatably mounted on said base unit, said arm having strap engagement means provided by a protuberance thereon, said arm being movable from a locked position to an open position, said arm in its locked position forcing the at least two straps into engagement with each other between said engagement means and said base unit, said arm being movable to an open position wherein said engagement means is rotated away from said straps so that said straps are free to move relative to each other and relative to said device.

2. A safety helmet comprising:

(a) a helmet for covering a portion of the head of a user thereof;

(b) at least two straps attached to said helmet and arranged to converge together at a selected point near an ear-lobe of the user; and (c) a device for fastening said at least two straps together at said selected point, said device including:

(i) a base unit having an opening therein sized to receive said at least two straps, and a base portion and opposing internal side-walls between which is received said straps, said opposing internal side walls flaring outwardly from a centerline of said base portion to accommodate straps which diverge in use; and (ii) an arm rotatably mounted on said base unit, said arm having strap engagement means provided by a protuberance thereon, said arm being movable from a locked position to an open position, said arm in its locked position forcing the at least two straps into engagement with each other between said engagement means and said base unit, said arm being movable to an open position wherein said engagement means is rotated away from said straps so that said straps are free to move relative to each other and relative to said device.

* * * * *